US005641087A

United States Patent [19]

Moffitt

[11] Patent Number: 5,641,087

[45] Date of Patent: Jun. 24, 1997

[54] PAINT BUCKET FOR A MINI ROLLER

[75] Inventor: Steven P. Moffitt, Guilford, Conn.

[73] Assignee: Steven P. Moffitt & John David Moffitt Partnership, Guilford, Conn.

[21] Appl. No.: 544,394

[22] Filed: Oct. 17, 1995

[51] Int. Cl.[6] ..... B65D 1/00; B65D 21/032

[52] U.S. Cl. ..... 220/608; 15/264; 206/520; 220/501; 220/694; 220/729

[58] Field of Search ..... 220/608, 694, 220/695, 696, 702, 555, 557, 570, 501; 206/520, 506, 509; 15/264, 248.2, 257.05, 257.06

[56] References Cited

U.S. PATENT DOCUMENTS

| | | | |
|---|---|---|---|
| D. 28,095 | 12/1897 | Mills . | |
| D. 186,195 | 9/1959 | Cole . | |
| D. 202,134 | 8/1965 | Bryan . | |
| D. 293,144 | 12/1987 | Papke et al. . | |
| D. 303,304 | 9/1989 | Sabatino . | |
| 2,661,858 | 12/1953 | Howell . | |
| 2,705,334 | 4/1955 | Farrow . | |
| 2,917,764 | 12/1959 | Whittle | 220/570 X |
| 2,988,767 | 6/1961 | Tretwold et al. | 220/695 X |
| 3,292,815 | 12/1966 | Smith et al. . | |
| 3,341,876 | 9/1967 | Campbell | 220/555 X |
| 3,351,970 | 11/1967 | Engh . | |
| 3,553,762 | 1/1971 | Padget, Jr. et al. . | |
| 4,145,789 | 3/1979 | Morgan, Sr. | 220/570 X |
| 4,428,493 | 1/1984 | McDonough | 220/555 |
| 4,706,918 | 11/1987 | Wilson . | |
| 4,927,046 | 5/1990 | Armstrong . | |
| 5,072,868 | 12/1991 | Dickie et al. . | |
| 5,086,917 | 2/1992 | Dziersk et al. | 220/555 X |
| 5,183,179 | 2/1993 | Morris, Sr. | 220/608 X |
| 5,201,439 | 4/1993 | Davies . | |
| 5,236,340 | 8/1993 | Hall et al. | 220/608 X |

*Primary Examiner*—Allan N. Shoap
*Assistant Examiner*—Niki M. Kopsidas

[57] ABSTRACT

A paint bucket having cylindrical side walls, a bottom, has two integrally-formed inclined rolling surfaces extending upward from the bottom and inward toward the center, which meet at a peak below the top rim and form rolling surfaces. The rolling surfaces are angled inward, the side walls are angled outward and the area underneath the rolling surfaces is hollow to allow multiple paint buckets to be stacked together.

8 Claims, 3 Drawing Sheets

PAINT BUCKET FOR A MINI ROLLER

FIELD OF THE INVENTION

The invention relates to a paint bucket and, more particularly, to a paint bucket for a mini roller having integrally-formed rolling ramps extending upwards from the bottom thereof.

BACKGROUND OF THE INVENTION

Paint rollers are and have been a common way to apply paint to a surface. For example full-size rollers, which are approximately nine inches in length and three inches in diameter, are used for covering large surfaces such as a complete wall. Mini-rollers, which are less than about five inches in length and less than about one and one-half inches in diameter, are used for painting boarders, trim and other such areas which require more precision.

Commonly, paint is applied to rollers by partially immersing the roller in paint, and then removing the roller and rolling it along a surface to remove excess paint and provide an even distribution of paint on the roller surface.

A well-known device for the above method is the common horizontal paint roller tray. This type of tray is an effective way for applying paint to rollers, however, it is intended to be placed on a flat, stationary surface and therefor, is of limited use when painting in remote places or on a ladder.

Variations of the above type of roller tray are disclosed in U.S. Pat. Nos. 2,661,858 to Howell and 3,351,970 to Engh. Both the Howell and Engh devices disclose a horizontal, portable paint tray with a paint well, a rolling surface extending out of the paint well, and a handle or strap for carrying the tray. While the Howell and Engh trays are portable and may be carried by the painter, because of the configuration of the opening of the tray, they cannot be easily covered during periods of non-use.

Another device for the application of paint to rollers is disclosed in U.S. Pat. No. 2,705,334 to Farrow. The Farrow device is a ramp which is inserted into a paint can. The Farrow ramp hooks onto the rim of the paint can and rests on the bottom of the can. This is also an effective device for applying paint to a roller, however, it is not integrally-formed into the paint can, and therefor requires assembly.

Various paint cans which do have integrally-formed ramps are disclosed in U.S. Utility Pat. Nos. 3,292,815 to Smith and 3,553,762 to Padgett, and U.S. Design Pat. Nos. D28,095 to Mills, D186,195 to Cole, D202,134 to Bryan, D293,144 to Papke, and D303,304 Sabatino. All of the patents mentioned immediately above disclose paint cans having ramps suitable for rollers. The ramps are formed in a portion of the side wall of the can and extend from the bottom of the can towards the rim.

The disadvantage of these types of paint cans, however, is that each requires additional structure under the ramp portion of the side wall in order to prevent the can from tipping over in the situation where force is applied to the ramp by the roller and there is insufficient counter-balancing weight in the can.

What is desired, therefore, is a portable, coverable paint can having an integrally-formed ramp for a roller which does not require additional support structure to prevent the can from tipping over when it is used.

SUMMARY OF THE INVENTION

Accordingly, it is an object of the invention to provide a paint bucket for the application of paint to a paint roller.

It is another object to provide a paint bucket for the application of paint to mini rollers that is portable.

It is another object of the present invention to provide a paint bucket with the above characteristics which is also stable and not prone to being tipped over when used.

It is yet another object of the present invention to provide a paint bucket with the above characteristics and which has a shape such that a plurality of buckets may be stacked together.

It is still another object to provide a paint bucket with the above characteristics having one or more inclined surfaces extending from the bottom of the bucket forming rolling surfaces.

It is yet another object of the present invention to provide a paint bucket having the above characteristics and wherein the area under the inclined roller surfaces extending from the bottom of the bucket is hollow thereby allowing multiple buckets to be stacked together.

In the preferred embodiment, the paint bucket of the present invention comprises a bucket having cylindrical side walls, a bottom, and a top rim. Two integrally-formed inclined surfaces, which extend upward from the bottom of the bucket and inward toward the center, meet at a peak below the top rim and form rolling surfaces. The area underneath the inclined surfaces is hollow to allow multiple paint buckets to be stacked together.

Preferably, the paint bucket is fabricated from a plastic material, and most preferably molded in a single piece from a number of plastics, including polypropolene. Because the design in symmetrical and stackable, it is also easy to mold. More specifically, the bucket can be formed in a two-piece mold wherein the mold separation line is at the rim of the bucket.

Since the bucket is intended for use with a mini-roller, the diameter of the opening in the bucket should be less than about ten inches, and the height of the bucket should be less than about ten inches. As best shown in FIG. 5, the width of the floor of the rolling surfaces should be less than about six inches, thereby leaving adequate space for the mini-roller to be inserted into, and fully touch, the bottom of the bucket. More specifically, the width (50) of the rolling surfaces at the floor of the bucket should be less than about three inches. This leaves sufficient area adjacent the rolling surfaces (20) to permit a mini-roller to be moved to the bottom on the bucket and dipped into paint. In a preferred embodiment of the invention, the diameter (52) of the floor of the bucket is less than about 8 inches, and the bottom (16) of the bucket is preferably flat.

Other embodiments of the invention and the particular features and advantages of all embodiments will become more apparent from the following detailed description considered with reference to the accompanying drawings.

DETAILED DESCRIPTION OF THE INVENTION

Figure 1:
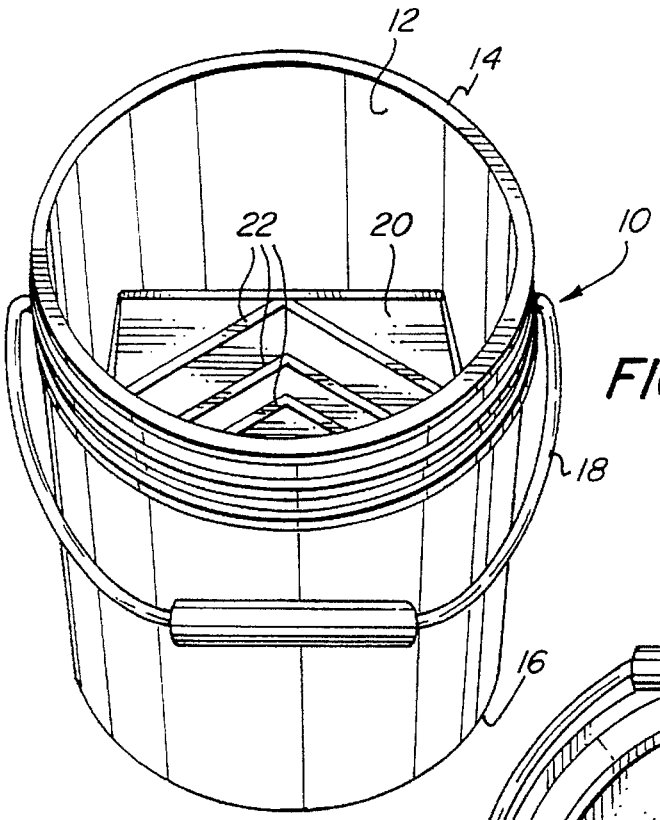
FIG. 1 is a perspective view of the paint bucket of the present invention.
Figure 3:
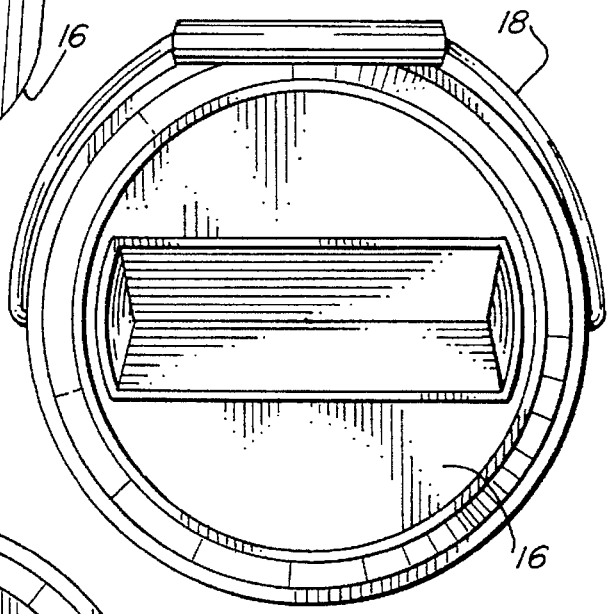
FIG. 3 is a bottom view of the paint bucket of FIG. 1.
Figure 2:
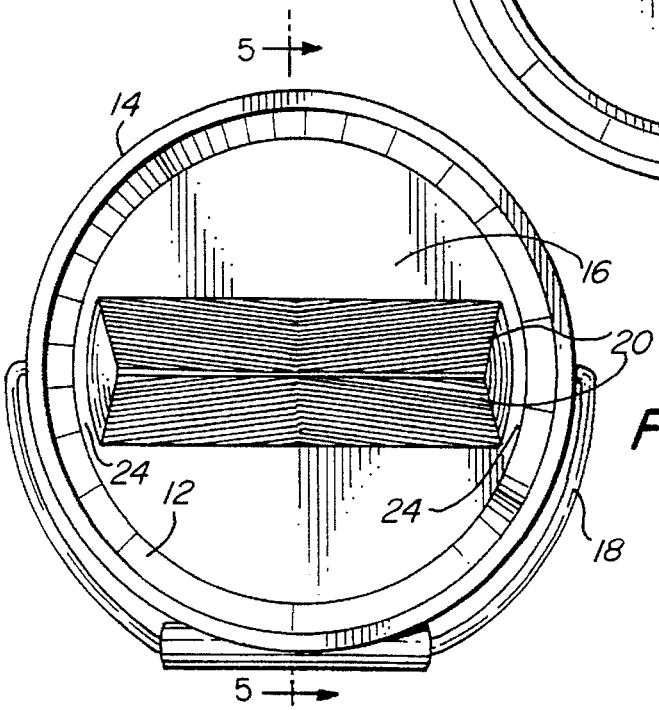
FIG. 2 is a top view of the paint bucket of FIG. 1.

Referring to FIGS. 1, 2, and 3, a paint bucket 10 of the present invention may include a cylindrical side wall 12 with a rim 14, and may also include a bottom 16. A handle 18 may also be attached near the rim 14. Rolling surfaces 20 extend upwards from the bottom 16 of the paint bucket 10. The rolling surfaces 20 may include ribs 22 to aid in the even distribution of paint on a conventional mini-roller.

Referring to FIG. 2, preferably the rolling surfaces 20 do not contact the side walls 12 thereby creating one or more channels 24 through which paint may flow. This prevents paint from becoming trapped on one side of the rolling surfaces 20 and allows more of the paint to be used.

Figure 4:
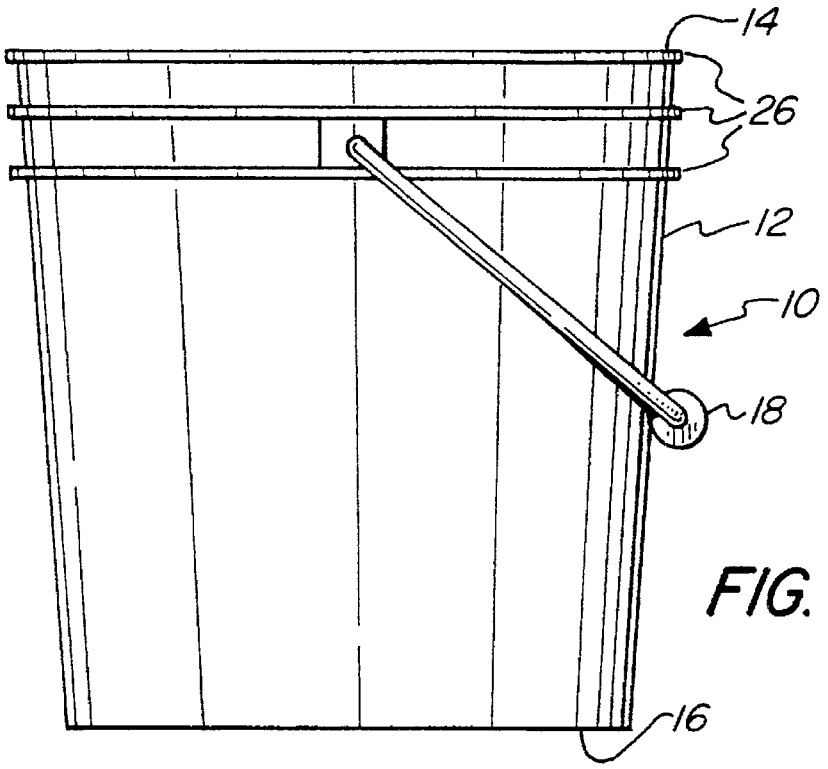
FIG. 4 is a side view of the paint bucket of FIG. 1, the other side being a mirror image.
Figure 5:
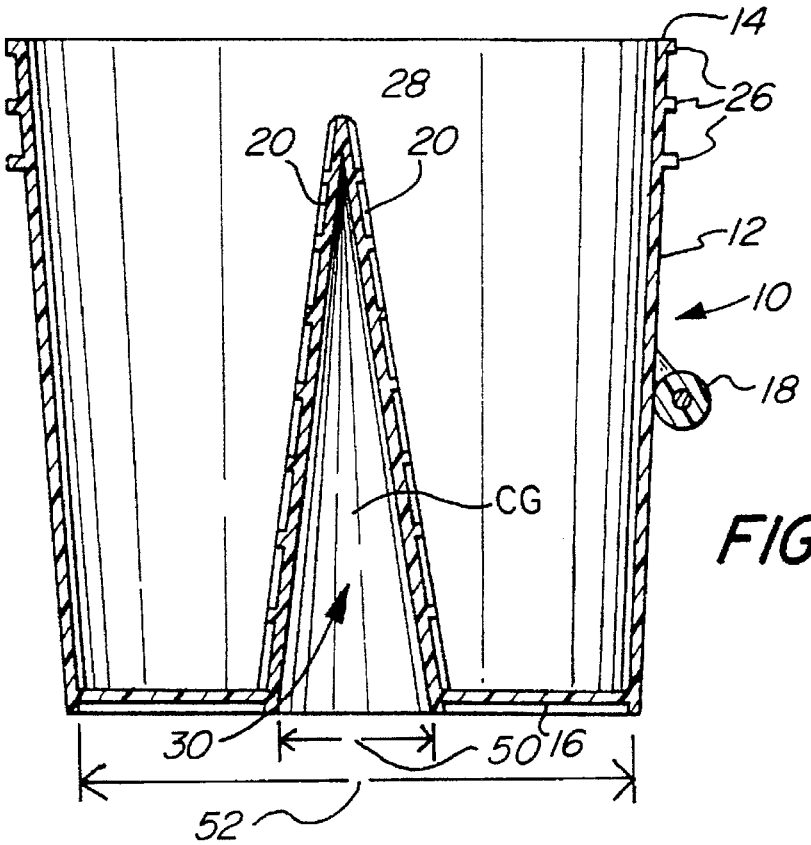
FIG. 5 is a vertical sectional view taken along line 5—5 in FIG. 2.

Referring to FIGS. 4 and 5, the side walls 12 of the paint bucket 10 are preferably angled outward, and the top rim 14 may include support rings 26 for added rigidity.

Preferably, the side walls 12, bottom 16 and rolling surfaces 20 are integrally-formed with one another. The rolling surfaces extend upward from the bottom and meet at a peak 28 below the rim. Preferably, the area 30 between the rolling surfaces 20 is hollow, and the side walls 12 are angled outward to allow multiple buckets to be stacked together.

Figure 6:
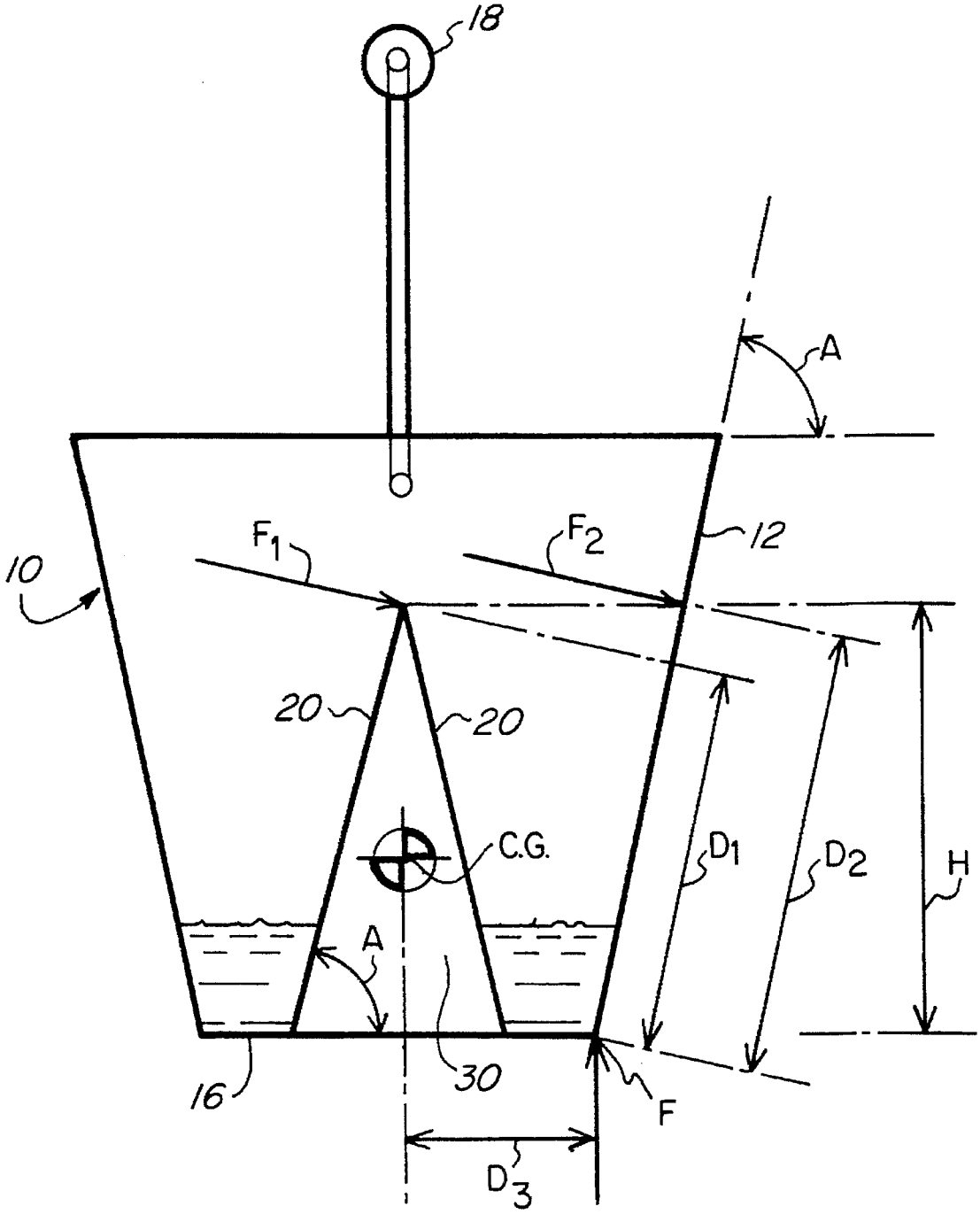
FIG. 6 is a modified schematic diagram of the paint bucket of FIG. 1 showing the benefits of providing a rolling ramp in the center of the bucket.

Referring to FIGS. 5 and 6, preferably the center of gravity CG of the paint bucket 10 lies between the rolling surfaces 20. With a given ramp angle A and force height H and force strength F1, F2, the bucket 10 will be less likely to tip over if the force F1 were applied to the rolling surface 20 than if it were applied to the side wall 12.

The reason for this is that the distance D1 through which a force F1 applied to the rolling surfaces 20 acts is less than the distance D2 through which an equal force F2 applied to a side wall 12 acts. This reduces the moment about the fulcrum F and lessens the likelihood that a given force F1, F2 at a given distance H above the bottom 16 will cause the bucket 10 to tip over.

Generally, any such moment decreases as the rolling surface 20 is moved in the direction of the center of gravity CG with respect to the fulcrum point F (here the edge of the bucket 10). To simultaneously decrease any such moment and provide symmetry of the bucket structure, preferably two ramps 20 are aligned over the center of gravity CG of the bucket 10.

Although the invention has been described with reference to a particular arrangement of parts, features and the like, these are not intended to exhaust all possible arrangements or features, and indeed many other modifications and variations will be ascertainable to those of skill in the art.

What is claimed is:

1. A paint bucket for applying paint to a roller comprising:

a bottom;

a side wall connected to said bottom, said side wall angled upwardly and outwardly;

two rolling surfaces connected to said bottom, said rolling surfaces angled upwardly and inwardly and meeting at a peak above said bottom;

said rolling surfaces, said side wall, and said bottom being integral and in one piece, and defining two wells for containing paint;

said rolling surfaces, said side wall, and said bottom also defining a channel between the rolling surfaces and the side wall to allow for the free flow of paint between said wells; and, said rolling surfaces defining a hollow area therebetween for facilitating the stacking of a plurality of said buckets.

2. A paint bucket as in claim 1 wherein said bucket further comprises a center of gravity and wherein said center of gravity lies between said rolling surfaces.

3. A paint bucket as in claim 2 where said bucket further comprises a vertical center plane passing through said center of gravity dividing said bucket into first and second halves, wherein said peak lies on said center plane, and wherein said first and second halves are substantially mirror images of one another.

4. A paint bucket as in claims 1, 2, or 3 comprising two channels.

5. A paint bucket for applying paint to a mini-roller having a length of less than about five inches comprising:

a bottom having a diameter of less than about eight inches;

a side wall connected to said bottom, said side wall angled upwardly and outwardly and extending for a height less than about ten inches;

two rolling surfaces connected to said bottom, said rolling surfaces angled upwardly and inwardly and meeting at a peak above said bottom;

said rolling surfaces, said side wall, and said bottom being integral and in one piece, and defining two wells for containing paint;

said rolling surfaces, said side wall, and said bottom also defining a channel between the rolling surfaces and the side wall to allow for the free flow of paint between said wells; and, said rolling surfaces defining a hollow area therebetween for facilitating the stacking of a plurality of said buckets.

6. A method for applying paint to a roller comprising:

providing a paint bucket having a bottom and side walls extending upwardly and outwardly;

providing two rolling surfaces connected to said bottom, said rolling surfaces angled upwardly and inwardly and meeting at a peak above said bottom;

providing a hollow space between said rolling surfaces and allowing a plurality of said buckets to be stacked;

defining two wells with said bottom, side walls, and rolling surfaces;

defining a channel between the rolling surfaces and the side wall with said bottom, side walls, and rolling surfaces;

disposing paint in said wells;

providing a roller;

partially immersing said roller in said paint;

rolling said roller along one of said rolling surfaces; and, allowing said paint to flow from one of said wells to the other of said wells through said at least one channel.

7. The method of claim 6 further comprising providing a center of gravity of said bucket and aligning said rolling surfaces such that said center of gravity is between said rolling surfaces.

8. The method of claim 7 further comprising providing a vertical center plane of said bucket; said center plane passing through said center of gravity and said peak and dividing said bucket into first and second halves, said first and second halves being substantially mirror images of one another.

* * * * *